US007299114B2

(12) United States Patent
Angenendt et al.

(10) Patent No.: US 7,299,114 B2
(45) Date of Patent: Nov. 20, 2007

(54) METHOD AND DEVICE FOR DETERMINING THE RESIDUAL TRAVEL DURATION OF A SUBMARINE

(75) Inventors: Hartmut Angenendt, Grob Grönau (DE); Michael Iskra, Kiel (DE)

(73) Assignee: Howaldtswerke-Deutsche Werft AG (DE)

( * ) Notice: Subject to any disclaimer, the term of this patent is extended or adjusted under 35 U.S.C. 154(b) by 618 days.

(21) Appl. No.: 10/806,759

(22) Filed: Mar. 23, 2004

(65) Prior Publication Data

US 2004/0199305 A1 Oct. 7, 2004

(30) Foreign Application Priority Data

Apr. 1, 2003 (DE) ..... 103 14 651

(51) Int. Cl.
*B63G 8/08* (2006.01)
*B63G 8/00* (2006.01)

(52) U.S. Cl. ..... 701/21; 701/22

(58) Field of Classification Search ..... None
See application file for complete search history.

(56) References Cited

U.S. PATENT DOCUMENTS 858,348 A 6/1907 Owens
3,589,176 A 6/1971 Wellons
3,683,622 A * 8/1972 Von Krusenstierna ..... 60/207
5,487,002 A * 1/1996 Diller et al. ..... 701/1
5,734,099 A * 3/1998 Saigo et al. ..... 73/114
5,913,917 A * 6/1999 Murphy ..... 701/123
6,063,515 A * 5/2000 Epp et al. ..... 429/17

FOREIGN PATENT DOCUMENTS

JP 57-190221 11/1982

* cited by examiner

*Primary Examiner*—Michael J. Zanelli
(74) *Attorney, Agent, or Firm*—McGlew and Tuttle, P.C.

(57) ABSTRACT

A method as well as a device are provided for determining the residual travel duration of a submarine, with which firstly for at least one certain travel situation a reference journey is carried out with which the power consumption of the submarine is detected as stored as a dependent-dependent consumption profile. Later, for the same travel situation, the residual travel duration or a residual capacity of a battery given a predefined travel duration is determined on the basis of the stored consumption profile and the current battery data.

21 Claims, 1 Drawing Sheet

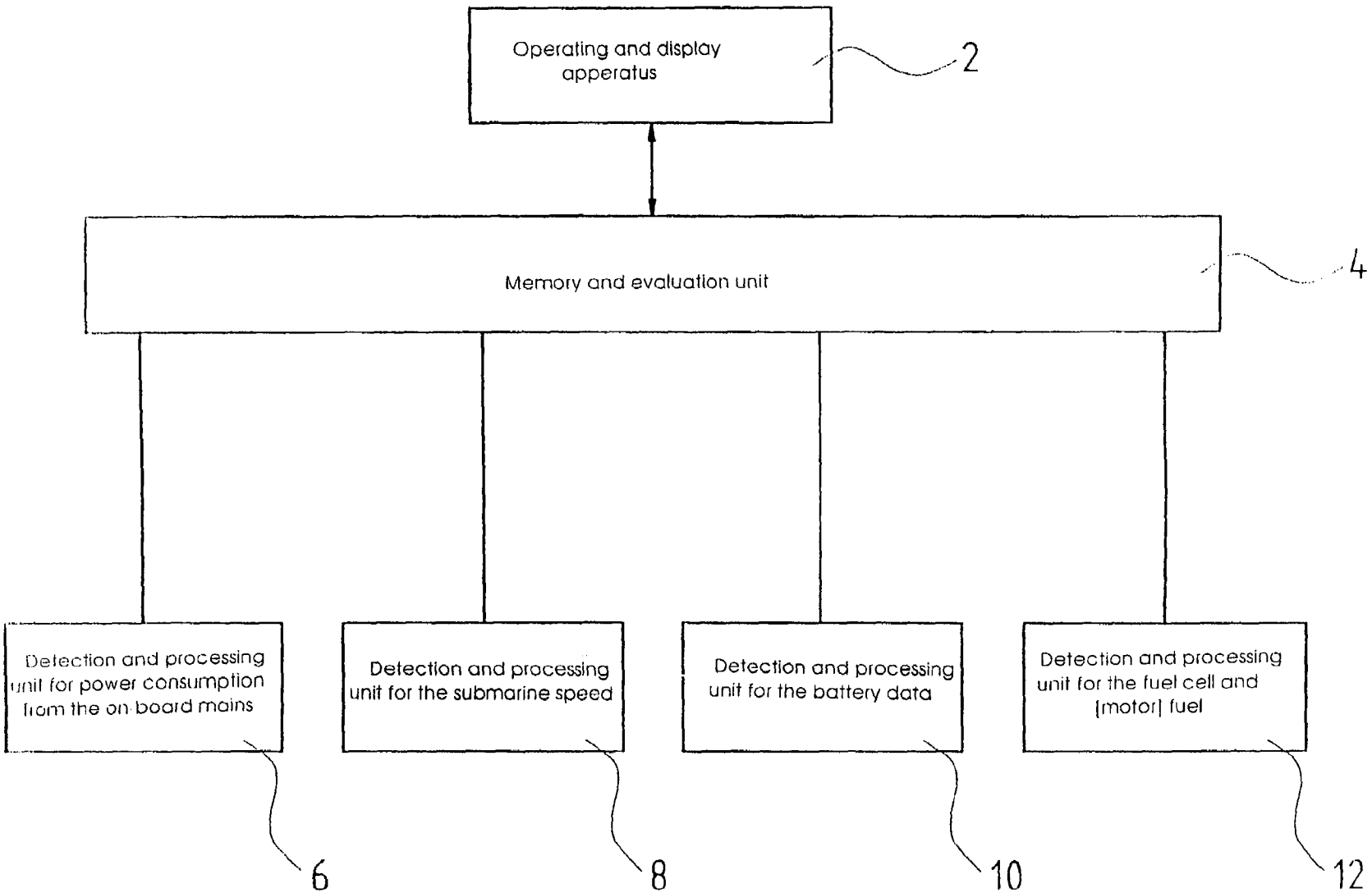
Operating and display apparatus
2
Memory and evaluation unit
4
Detection and processing unit for the fuel cell and [motor] fuel
12
Detection and processing unit for the battery data
10
Detection and processing unit for the submarine speed
8
Detection and processing unit for power consumption from the on board mains
6

METHOD AND DEVICE FOR DETERMINING THE RESIDUAL TRAVEL DURATION OF A SUBMARINE

CROSS REFERENCE TO RELATED APPLICATIONS

This application claims the benefit of priority under 35 U.S.C. § 119 of German patent application DE 103 14 651 filed Apr. 1, 2003, the entire contents of which are incorporated herein by reference.

FIELD OF THE INVENTION

The invention relates to a method as well as to a device for determining the residual travel duration or the residual capacity of the battery of a submarine.

BACKGROUND OF THE INVENTION

For conventional submarines, the battery in certain situations of application is the only source of energy. In order to be able to compute in advance the remaining travel duration which is possible, it is not sufficient to known the available energy quantity. On the contrary, the residual travel duration is rather dependent on several parameters. These are the battery operating parameters as well as the operating parameters of the remaining units of the submarine. The respective battery data are made available by a battery monitoring installation. For the remaining units of the submarine, calculated consumption values for common operating situations are specified by the shipyard, on the basis of which then with certain battery data the possible residual travel duration given a certain travel situation or the residual capacity of the battery remaining given a predefined travel duration may be determined by calculation.

The disadvantage with these known methods for determining the residual travel duration or remaining travel time of a submarine is the fact that the residual travel duration or the remaining residual capacity of a battery may only be determined relatively inaccurately.

SUMMARY OF THE INVENTION

It is therefore the object of the invention to provide an improved device for determining in advance the residual travel duration of a submarine which permits a more exact advance evaluation of the residual travel duration or the residual capacity of the battery after a predefined travel duration.

This object is achieved by a method according to the invention as well as a device according to the invention.

The method according to the invention permits a more accurate prediction of the residual travel duration of a submarine or a more accurate prediction of the residual capacity of a battery after a predefined travel time since the computation is not based on calculated determined consumption values predefined by the shipyard for the individual units of the submarine, but on the basis of consumption profiles determined with regard to measurement technology under real conditions. For determining these consumption profiles, a reference journey is firstly carried out for at least one certain travel situation of the submarine. Such a travel situation may for example be a locating journey, crawling journey, an underwater cruise or an above-water journey, wherein with these individual travel situations in each case certain units of the submarine are in or not in operation. With the reference journey which is carried out, the power consumption of the submarine is ascertained for the defined travel situation and is stored as a situation-dependent consumption profile. At the same time the power consumption of all units which are in operation with the certain travel situation is preferably ascertained in order to produce an as accurate as possible consumption profile. The situation-dependent consumption profile for a certain travel situation evaluated and stored in this manner is later used for the advance computation of a remaining residual travel duration or remaining residual capacity of the battery. Current battery data which provides information on the remaining capacity or the charged conditioned of the battery is used for evaluating the residual travel duration, and then with the current evaluated battery data, the remaining residual travel duration is calculated on the basis of the situation-dependent consumption profile which matches the intended travel situation and has been stored during the reference journey. One thus determines for which residual travel duration the present energy is sufficient. Alternatively, given a predefined travel duration one may determine the residual capacity of the battery remaining after this travel duration. The method according to the invention has the advantage that the situation-dependent consumption profiles may be determined again and again under real conditions. Thus for example the required reference journey may be carried out after the submarine has left the harbor in order then for the remaining journey to have current consumption profiles available for computing the travel duration. Thus when determining the consumption profiles, changes of the submarine caused by aging or also technical changes are taken into consideration. For example the incrustation of foreign matter on the outer skin and other resistance-increasing effects increase the power requirement of the propeller motor given an equal speed of submarine. The power consumption of some auxiliary machines of the vessel may be increased on account of ageing effect, for example leakages, wear etc. Since the required reference journeys are carried out at regular intervals, preferably when putting out to sea, such changes in the consumption profiles may be taken into account and thus a residual travel duration in a certain travel situation may be computed in advance more accurately on account of the more accurate consumption values. This permits a reduction of the required safety tolerances on computing the travel duration.

Preferably reference journeys are carried out for several predefined travel situations, with which in each case the power consumption of the submarine is detected and stored as a specific situation-dependent consumption profile specific to the respective travel situation. Reference journeys are for example carried out for the travel situations of a locating journey, crawling journey, underwater cruising etc., and a specific situation-dependent consumption profile is stored for each of these travel situations. If later for example the remaining residual travel duration is to be evaluated for a crawling journey at a predefined speed, the specific consumption profile which has been evaluated and stored for the crawling journey is used in order to determine the remaining residual travel duration on the basis of the current battery data. Situation-specific and in particular speed-specific consumption profiles are recorded for all common travel situations; in order later for these travel situations, to be able in each case to compute in advance the residual travel duration as accurately as possible.

With regard to the reference journey, preferably in one travel situation an average of the detected power consumption is formed over a certain, preferably selectable measurement interval. The detection of the power consumption over a longer measuring interval and the formation of an average over this measuring interval permits a more accurate evaluation of the power consumption specific to the respective travel situation. One may thus determine an accurate consumption profile for the respective travel situation.

A previously stored matching consumption profile is usefully able to be selected by an operator for the computation of the residual travel duration or residual capacity of the battery which is to be carried out. The stored consumption profiles are preferably offered for selection by a computer so that the operator may select the matching profile for the desired travel situation and by way of the computer a computation of the residual travel duration of the submarine in the defined travel situation may be carried out of the basis of the current battery data. Alternatively for a predefined journey duration one may compute the residual capacity of a battery which remains after the completion of the journey duration in a corresponding manner. The selection possibility of the various consumption profiles by an operator allows, for various travel situations or speeds, for the remaining residual travel durations to be run through and then for that travel situation or speed to be selected at which a required travel duration may be realized, and to indeed to travel at this.

The speed of the submarine during the reference journey is usefully kept constant by way of a suitable operation of a propeller motor, in order for the respective travel situation and speed to be able to evaluate an as accurate as possible consumption profile. For one travel situation, there exists the possibility of being able to evaluate and store a situation- and speed-dependent consumption profile in each case for different speeds. Thus later the residual travel duration may be computed not only on the basis of a specific travel situation but also on the basis of a certain travel speed in this travel situation, so that the residual travel duration may be estimated even more accurately or the maximal speed which may be realized may be determined for a certain residual travel duration.

Additionally, for a predefined travel situation a consumption profile which is not determined by a reference journey may be interpolated from at least two other consumption profiles evaluated by a reference journey. By way of interpolation, speed-dependent consumption profiles may be evaluated in this manner for speeds at which no reference journeys have been carried out. For this, the consumption profile for the desired speed value is interpolated from two consumption profiles for adjacent speed values which have been determined by a reference journey. This offers the advantage that the residual travel duration may also be computed for speed values which are independent of the evaluation. The operator selects the respective travel situation on the installation, and selects the speed value to be taken into account separately from this. The consumption profile for this speed value is then computed by interpolation from two stored consumption profiles of adjacent speed values in the same travel situation. On the basis of this consumption profile one may then determine in advance the residual travel duration or the residual capacity at this speed. A storage of the consumption profile computed in this manner is not required since the computation may be newly effected at any time.

According to a preferred embodiment of the method, additionally the fuel reserve of at least one charging unit is detected and taken into account on computation of the residual travel duration or the residual capacity of a battery. The charging unit as for example is usual with conventional submarines may be a diesel machine with a generator, wherein the fuel or diesel reserve is included in the computation of the residual travel duration. If apart from the current available battery capacity one also includes the remaining fuel reserve in the computation, the residual travel duration may thus be computed on the basis of the whole remaining energy sources of the submarine whilst taking all energy sources into account, so that one may compute in advance a maximal complete journey duration for a certain travel situation and certain speed.

With a submarine having a fuel cell installation it is furthermore preferable to ascertain the fuel reserve and oxidant reserve of the fuel cell installation of the submarine and to take this into account on computation of the residual travel duration or the residual capacity of the battery. Thus here too one may very accurately determine the computation of the residual travel duration or the remaining residual capacity of the battery after a predefined travel duration on the basis of the complete remaining energy reserve of a submarine. Usually a submarine provided with a fuel cell installation is operated such that the fuel cell installation secures the main load whilst the battery or batteries of the submarine merely make up for the power peaks. If on account of the previously carried-out reference journey the exact power consumption is stored in the form of a situation-dependent consumption profile for the respective travel situation, then on computation of the residual travel duration the power output required for the travel situation may be distributed onto the batteries and the fuel cell installation in a manner such that a desired residual travel duration or a desired residual capacity of the battery may be realized after completion of the travel duration. At the same time the distribution of the power to be outputted by the batteries and by the fuel cell installation may be adapted to the current battery data, in particular the current battery capacity as well as the currently present fuel and oxidant reserve of the fuel cell installation.

The power consumption of a propeller motor or several propeller motors and the remaining units of the submarine may be detected together at one point of measurement. In this manner the measurement of the whole power consumption of the submarine, which is to say the power consumption of the electrical propeller motor or the propeller motors and all remaining units may be effected at one point of measurement. The common measurement of the power consumption of the propeller motor or the propeller motors and all other units of the submarine may be also effected in a manner such that the power flow is detected at all points via which in each case a part of the total power flows, wherein the complete sum of the power consumption is formed by the measured individual values.

The detection of the power consumption of the propeller motor or propeller motors and the remaining units of the submarine is alternatively effected separately from one another at least two points of measurement. This permits the separate detection of the power consumption of various aggregates in the submarine, by which means the power consumption of individual units may be taken into account when determining situation-dependent consumption profiles for certain travel situations. The consumption profiles evaluated in this manner are more differentiating since they take into account the power consumption of the individual units. Thus with a later computation of the residual travel duration or the remaining battery capacity on the basis of the previously evaluated consumption profile one may take into account whether certain units have been switched on or not in the respective travel situation. Such a more differentiating consideration of the consumption of the individual units may also be effected by carrying out several reference journeys with which the individual units are respectively switched on or off. If however the power consumption of individual units is effected directly at different points of measurement, then individual reference journeys may be spared, and the evaluation of situation-dependent consumption profiles may be effected more quickly and simply.

Apart from the described method, the invention relates to a device for carrying out the previously described method for determining the residual travel duration of a submarine. The device according to the invention for determining the residual travel duration of a submarine or for the advance evaluation of the remaining residual capacity of the battery of a submarine after a predefined travel duration comprises a computer, a display and input means as well as a detection unit for detecting the power consumption of the submarine. With this, the detection unit preferably detects the whole power consumption of the submarine, that is to say the power consumption of all units and of the propeller motor. The computer of the device according to the invention comprises a profile production module for producing at least one situation- and/or speed-dependent consumption profile at least one certain travel situation. At the same time the profile production module sets up a certain situation- and/or speed-dependent consumption profile on the basis of the data detected by the detection unit, which is to say the power consumption of the submarine in a certain travel situation. For creating the consumption profile, a reference journey is effected in a certain travel situation at which certain units of the submarine required for the travel situation are switched on and at with which the travel is at a certain, preferably constant speed. With this reference journey the detection unit detects the power consumption of the submarine and the profile production module of the computer produces a situation- and/or speed-dependent consumption profile for this specific travel situation on the basis of the detected power consumption. Furthermore a memory module for storing the produced consumption profile is provided in the computer according to the device according to the invention. After creating the situation-dependent consumption profile by the profile production module, the consumption profile is stored in the memory module for later use. In this manner one may evaluate a multitude of different situation-dependent consumption profiles for various travel situations and various speeds by way of reference journeys, and store them in the memory module. The computer furthermore comprises a computation module for computing the residual travel duration in a certain travel situation on the basis of a stored consumption profile for this travel situation and current battery data. The computation module is installed such that preferably after the selection by the operator, via the input means it reads out a certain previously stored consumption profile from the memory module and then, on the basis of currently determined battery data which for example is made available by a battery monitoring unit, the remaining residual travel duration of the submarine is determined for the travel situation associated with the read-out consumption profile. Alternatively the operator via the input means may input an intended travel duration, and by the computation module on the basis of a consumption profile read out from the memory module and the current battery data, that is to say in particular the remaining battery capacity, the remaining residual capacity of the battery may be determined after completion of the travel duration. Furthermore the computation module may be set up such that for a certain travel situation on the basis of different consumption profiles for this travel situation which have been evaluated for various travel speed, via the display means of the device it outputs to the operator the various residual travel durations or various residual capacities of the battery for different travel speeds. The operator then, on the basis of the outputted data and the external conditions such as the flow speed of the surrounding sea, may decide which speed with the respective travel situation is to be selected in order to travel a certain maneuver, or to be able to safely reach a certain location given the remaining capacity of the battery. By way of detecting the consumption profiles under real conditions, a very accurate evaluation or computation of the remaining residual travel duration for a certain travel situation on the basis of the current battery capacity, the fuel reserves and/or reactor reserves of a fuel cell installation is possible.

The device preferably comprises an interface to a battery monitoring means for transmitting the current battery data to the computer. Thus for example the current battery capacity or the current charged condition of the battery may be transmitted to the computer by the battery monitoring means. In this manner the data which is detected by the means which are present anyway in the submarine may be automatically used for determining the residual travel duration, without having to be inputted into the computer by hand by an operator.

Furthermore, an interface to a travel measurement means for transmitting current travel data is preferably to be provided. Thus for example the current travel speed may be transmitted by the travel measurement means directly to the computer via the interface. The profile production module of the computer may then directly incorporate the transmitted travel speed into the produced consumption profile and store it with this, so that later a specific consumption profile for this speed is available. The interface at the same time has the advantage that the speed data does not need to be inputted into the computer by hand via the input means. Reversely, the interface may also be used to transmit speed data from the computer to the travel measuring means or to a travel controller. Thus the required reference journeys for determining the different situation-dependent consumption profiles may at least be effected partly automatically in a manner such that the speeds for which consumption profiles are to be evaluated and at which the reference journeys need to be carried out as a result of this, are transmitted from the computer to a travel measurement or travel control means, which then controls the drive motor of the submarine so that the speed required for the measurement remains constant for the measurement duration.

According to a further preferred embodiment, an interface to a submarine installation automation for transmitting required data to the computer are present. Such an interface permits a further integration of the travel duration computer into remaining computer installations of the submarine for installation automation. Thus the data required for the production of the consumption profiles for producing the consumption profiles and the computation of the residual travel duration or the residual capacity may be transmitted from the installation automation via the interface to the computer. Reversely on carrying out the reference journeys, data and control commands may be transmitted from the travel duration computer to the installation automation, in order e.g. to automatically control the units of the submarine in the manner required for the travel situation of the reference journey.

It is further preferred for the computer, the display means and input means and/or the detection unit to be an integral part of an automation system or a battery monitoring means. In this manner a further integration of the individual control or regulation means of the submarine may be achieved and interfaces between individual modules or components may be avoided. The computer or the travel duration computer then only requires interfaces to those components which are not monitored or controlled by the installation in which the computer is integrated. If the computer for example is integrated into a battery monitoring means, the computer no longer requires an interface to the battery monitoring means since it is an integral component of this. The computer however for example requires an interface to the travel measurement means in order to be able to draw data from this in an automized or automated manner.

The device is preferably merely designed as a software module in an automation system or a battery monitoring means. This means that the device according to the invention for determining the residual travel duration is merely made available as a computer program which is integrated in a computer installation of another module or another installation of the submarine. In this manner the capabilities of an existing automation or an existing computer are widened by the functionality of the travel duration computation. The hardware and in particular the display and input means of the existing installation are therefore likewise used for the travel duration computer. The profile production module, the memory module and the computation module are accordingly made available merely as software components.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The invention is described by way of example by way of the attached graphical representation.

DETAILED DESCRIPTION OF THE INVENTION

The attached block diagram shows the structure of the device for carrying out the method according to the invention for determining the residual travel duration of a submarine or for determining the residual capacity of the battery of a submarine with a predefined travel duration. The battery may in the known manner consist of several part batteries. The installation comprises an operation and display unit 2 via which the communication to the user is effected, that is to say data may be input by the user and data may be displayed to the user or operator. The installation further comprises a memory and evaluation unit 4 which is connected to the operating and display apparatus 2 in a manner such that the data is transmitted via the operating apparatus 2 to the evaluation unit 4 and may be output by the evaluation unit 4 via the display apparatus 2.

The memory and evaluation unit 4 is further connected to various detection and processing units 6, 8, 10 and 12. For the operation of the method at least one detection and processing unit 6 for determining the power consumption of the units of the submarine from the on-board mains must be present. Furthermore at least one detection and processing unit 8 for detecting the submarine speed as well as a detection and processing unit 10 for detecting the current battery data need to be present. The detection units 6 and 8 are required for determining individual situation-dependent consumption profiles when carrying out the reference journey. Thus within the framework of reference journeys, various travel situations at different speeds are gone through and in each case the submarine speed and the power consumption from the on-board mains are detected. The detection of the power consumption is effected via special sensors in the on-board mains of the submarine or via sensors present in other units which detect the required power data. The evaluation unit 4 then evaluates a situation-dependent and speed-dependent consumption profile specific to the respective travel situation and stores this in the memory unit 4. For example a reference journey for the travel situation "profile Locating Journey 3 knots" may be carried out and a corresponding consumption profile may be stored under the reference "profile Locating Journey 3 knots". Consumption profiles for various travel situations at different speeds are determined and stored in this manner.

Then later, on the basis of this consumption profile stored in the memory and evaluation unit 4, one may determine a remaining residual travel duration or residual capacity of the battery given a predefined travel duration on the basis of the current battery data. For this the current battery data, which is to say in particular the charged condition or the current capacity of the battery or the batteries are detected on-line by the detection and processing unit and transmitted to the memory and evaluation unit 4. An operator, via the operating and display apparatus 2, selects the desired travel situation and as the case may be, a certain speed, for which then the memory and evaluation unit 4 evaluates the matching stored consumption profile and on whose basis and the basis of the current battery data, displays the residual travel duration which results from the given charged condition of the batteries. Alternatively an intended travel duration in a certain travel situation and at a certain speed may be input by an operating apparatus 2, wherein then the evaluation unit 4 computes in advance the remaining residual capacity of the batteries after the travel duration on the basis of the current battery data and emits this via the display apparatus.

A detection and processing unit 12 for detecting the fuel reserve and/or the fuel-and oxygen reserve of a fuel cell installation of the submarine of a fuel cell installation of the submarine may optionally be provided in the device according to the invention. If the memory and evaluation unit 4 also takes into account that data made available by the detection unit 12 with regard to the reserve of conventional fuel, for example diesel, and fuel for a fuel cell installation, it is possible to determine the remaining total travel duration of the submarine whilst taking all energy reserves into account. In particular it is possible to determine such a travel duration whilst taking certain setting for the distribution of the loads on the fuel cell installation and batteries into account. Thus on computation by the evaluation unit 4, where appropriate taking into account certain settings inputted at the operating apparatus, the current charged condition of the batteries as well as the fuel reserve for the fuel cell installation may be taken into account, and during the journey the power output of the fuel cell installation and the battery may be distributed such that the battery capacity and the fuel of the fuel cell installation may be optimally exploited.

The shown and described installation may be made available as an individual computer with its own sensors for the detection and processing units 6, 8, 10, and 12. It is alternatively possible to integrate the installation into existing installation, in particular into existing on-board computers of the submarine as hardware or software modules in order to reduce the number of required interfaces for data transmission, and the number of individual computer installations. Thus of the detection units 6, 8, 10 and 12 one may use sensors which are anyway present in the submarine. In this manner the number of additional components required for the travel duration computation according to the invention is kept low.

While a specific embodiment of the invention has been shown and described in detail to illustrate the application of the principles of the invention, it will be understood that the invention may be embodied otherwise without departing from such principles.

What is claimed is:

1. A method for determining the residual travel duration of a submarine, the method comprising:

providing a submarine with a pressure hull and an electric battery inside the pressure hull;

firstly, for at least one certain travel situation of the submarine, carrying out a reference journey through water, with which the power consumption of the submarine is detected, and stored as a situation-dependent consumption profile; and later, for the same travel situation of the submarine, predicting the residual travel duration or a residual capacity of a battery after a predefined travel duration on the basis of the stored consumption profile and the current battery data.

2. A method according to claim 1, wherein reference journeys are carried out for several predefined travel situations with which in each case the power consumption of the submarine is detected and is stored as a situation-dependent consumption profile specific to the respective travel situation.

3. A method according to claim 1, wherein during the reference journey in a travel situation an average value of the recorded power consumption is formed over a measurement interval.

4. A method according to claim 1, further comprising selecting a previously stored matching consumption profile by an operator for the computation of the residual travel duration or of the residual capacity of the battery to be carried out.

5. A method according to claim 1, wherein during a reference journey the speed of the submarine is kept substantially constant and the power consumption which is detected is stored as a situation-dependant and speed-dependent consumption profile.

6. A method according to claim 1, wherein for a predefined travel situation a consumption profile which is not determined by a reference journey is interpolated from at least two other consumption profiles determined by a reference journey.

7. A method according to claim 1, further comprising detecting the fuel reserve of at least one charging unit and taking the fuel supply into account on computing the residual travel duration or the residual capacity.

8. A method according to claim 1, further comprising detecting the fuel and oxidant reserve of a fuel cell installation of the submarine and taking the fuel and oxidant reserve of a fuel cell installation into account on computation of the residual travel duration or the residual capacity.

9. A method according to claim 1, wherein the power consumption of a propeller motor and remaining power consumption units of the submarine are detected together at one point of measurement.

10. A method according to claim 1, wherein the power consumption of a propeller motor and remaining power consumption units of the submarine are detected separately from one another at least two different points of measurement.

11. A device for determining the residual travel duration of a submarine, the device comprising: a computer; a display; input means; and a detection unit for detecting the power consumption of the submarine, said computer, said display, said input means and said detection unit being arranged inside a pressure hull of said submarine, said computer comprising a profile production module for producing at least one situation-dependent consumption profile with at least one certain travel situation on the basis of data detected from the detection unit, a memory module for storing the produced consumption profile and a computation module for computing the residual travel duration in a certain travel situation on the basis of a stored consumption profile for this travel situation, and current battery data.

12. A device according to claim 11, further comprising an interface to a battery monitoring means for transmitting current battery data to the computer.

13. A device according to claim 11, further comprising an interface to a travel measurement means for transmitting current travel data to the computer.

14. A device according to claim 11, further comprising an interface to a submarine installation automation for transmitting necessary data to the computer.

15. A device according to claim 11, wherein at least one of the computer, the display, the input means and the detection unit are integral components of an automation system or a battery monitoring means.

16. A device according to claim 11, wherein the computer, the input means and the detection unit are implemented with a software module in an automation system or a battery monitoring means.

17. A method for determining an energy consumption of a vehicle, the method comprising:

performing a plurality of reference journeys with the vehicle, each reference journey having a different travel situation;

separately measuring energy consumption of the vehicle during each of the reference journeys;

independently storing values of the energy consumption during each of the reference journeys as situation-dependent consumption profiles;

providing a predefined journey with a plurality of possible travel situations;

comparing each of the possible travel situations with a matching one of the situation dependent consumption profiles to determine an energy consumption of each of the possible travel situations.

18. A method in accordance with claim 17, further comprising:

determining the energy available for the predefined journey;

comparing the energy consumption of each of the possible travel situations with the energy available;

determining which of the possible travel situations are possible with the energy available.

19. A method in accordance with claim 17, wherein:

said performing of a plurality reference journeys is performed with the vehicle traveling through water, with one of said plurality of reference journeys being under water;

all of said possible travel situations of said predefined journey are through water, with one of said plurality of possible travel situations being under water;

said predefined journey is in a different geographical location than said reference journeys.

20. A method for determining the residual travel duration of a vehicle, the method comprising:

firstly, for at least one certain travel situation of the vehicle, carrying out a reference journey, during the reference journey the speed of the vehicle is kept substantially constant and the power consumption is detected and stored as a situation-dependant and speed-dependent consumption profile; and later, for the same travel situation of the vehicle, predicting the residual travel duration or a residual capacity of a battery after a predefined travel duration on the basis of the stored consumption profile and the current battery data.

21. A method for determining the residual travel duration of a vehicle, the method comprising:

firstly, for at least one certain travel situation of the vehicle, carrying out a reference journey, with which the power consumption of the vehicle is detected, and stored as a situation-dependent consumption profile; and later, for the same travel situation of the vehicle, predicting the residual travel duration or a residual capacity of a battery after a predefined travel duration on the basis of the stored consumption profile and the current battery data, a predefined travel situation with a consumption profile which is not determined by a reference journey is interpolated from at least two other consumption profiles determined by a reference journey.

* * * * *

UNITED STATES PATENT AND TRADEMARK OFFICE

CERTIFICATE OF CORRECTION

PATENT NO. : 7,299,114 B2
APPLICATION NO. : 10/806759
DATED : November 20, 2007
INVENTOR(S) : Angenendt et al.

It is certified that error appears in the above-identified patent and that said Letters Patent is hereby corrected as shown below:

On the title page, item [75] should read

--Inventors: Hartmut Angenendt, Gross Grönau (DE);
Michael Iskra, Kiel (DE)--.

Signed and Sealed this

Sixth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,299,114 B2
APPLICATION NO. : 10/806759
DATED : November 20, 2007
INVENTOR(S) : Angenendt et al.

It is certified that error appears in the above-identified patent and that said Letters Patent is hereby corrected as shown below:

On the title page, item [73] should read:

(73) Assignee: Howaldtswerke-Deutsche Werft GmbH (DE)

Signed and Sealed this

Second Day of September, 2008

JON W. DUDAS
*Director of the United States Patent and Trademark Office*